US006884180B2

(12) United States Patent
Corzilius et al.

(10) Patent No.: US 6,884,180 B2
(45) Date of Patent: Apr. 26, 2005

(54) SELF-RECORDING GOLF BALL, GOLF BALL CUP, AND READING DEVICE SYSTEM

(76) Inventors: Brian S. Corzilius, 26803 Oak Knoll Ter., Cloverdale, CA (US) 95425; Luis Perez, 281 W. Valleybrook Rd., Califon, NJ (US) 07830

( * ) Notice: Subject to any disclaimer, the term of this patent is extended or adjusted under 35 U.S.C. 154(b) by 0 days.

(21) Appl. No.: 10/165,612

(22) Filed: Jun. 7, 2002

(65) Prior Publication Data

US 2003/0228934 A1 Dec. 11, 2003

(51) Int. Cl.[7] ..... A63B 37/00; A63B 57/00

(52) U.S. Cl. ..... 473/351; 473/176; 473/180; 473/190; 473/192

(58) Field of Search ..... 473/151–155, 473/175, 176, 178, 180, 183, 190, 192, 198, 199, 200, 353

(56) References Cited

U.S. PATENT DOCUMENTS 4,940,236 A * 7/1990 Allen ..... 473/223
5,008,839 A * 4/1991 Goodwin et al. ..... 700/306
5,054,785 A * 10/1991 Gobush et al. ..... 473/199
5,447,314 A * 9/1995 Yamazaki et al. ..... 473/353
5,582,550 A * 12/1996 Foley ..... 473/153
5,722,046 A * 2/1998 Serfaty et al. ..... 340/7.35
5,743,815 A * 4/1998 Helderman ..... 473/353
5,767,778 A * 6/1998 Stone et al. ..... 340/636.1
6,196,932 B1 * 3/2001 Marsh et al. ..... 473/223
6,299,553 B1 * 10/2001 Petuchowski et al. ..... 473/409
6,375,580 B1 * 4/2002 Schmidt et al. ..... 473/137
6,572,492 B1 * 6/2003 Tinsman ..... 473/353

* cited by examiner

*Primary Examiner*—Julie Brocketti
(74) *Attorney, Agent, or Firm*—Hahn Loeser & Parks, LLP; Robert J. Clark

(57) ABSTRACT

The present invention provides a self-recording golf ball having an inner core defined by an outer cover, said golf ball further comprising a microprocessor, a power source, a receive and transmit device, and a piezo sensor electrically connected to one another and housed within said inner core of said golf ball; wherein the microprocessor further is programmed to record data corresponding to strokes received by the ball and to transmit the data, via the receive and transmit device, to a second microprocessor.

12 Claims, 5 Drawing Sheets

SELF-RECORDING GOLF BALL, GOLF BALL CUP, AND READING DEVICE SYSTEM

TECHNICAL FIELD

The present invention is directed to golf balls, golf ball cups, and golf ball reading devices designed, in certain embodiments, to record the number of strokes received by a golf ball during play between successive rounds and/or verify original ball-in-play.

SUMMARY OF THE INVENTION

The present invention provides a self-recording golf ball having an inner core defined by an outer cover, said golf ball further comprising a microprocessor, a power source, a receive and transmit device, and a piezo sensor electrically connected to one another and housed within said inner core of said golf ball; wherein the microprocessor further is programmed to record data corresponding to strokes received by the ball and to transmit the data, via the receive and transmit device, to a second microprocessor.

DETAILED DESCRIPTION OF THE EMBODIMENTS

Figure 1:
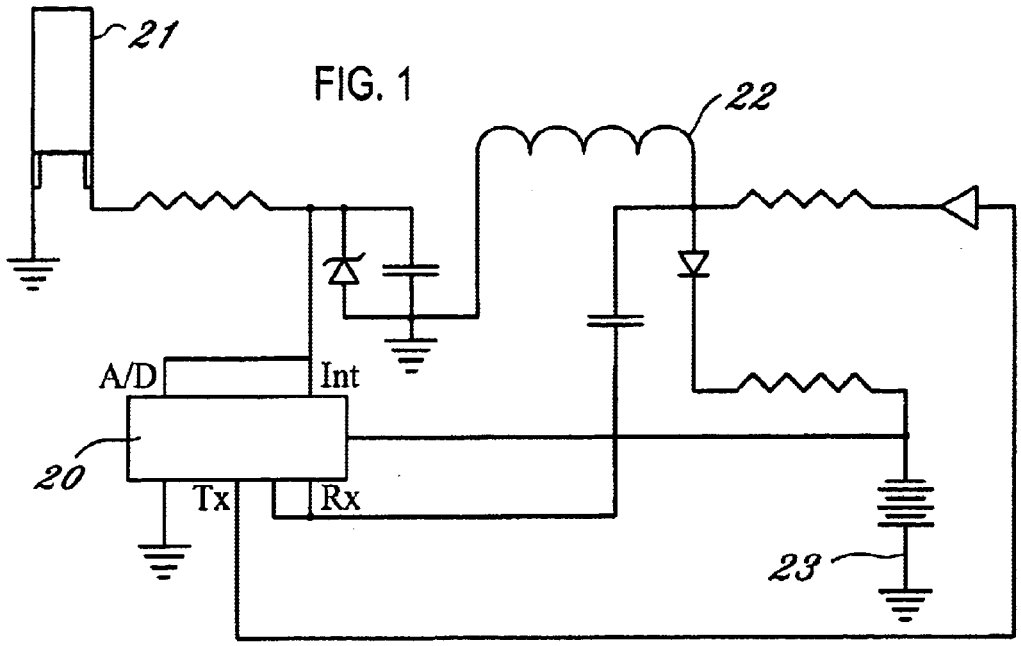
FIG. 1 is an exemplary schematic of electrical circuitry of one embodiment of the inventive golf ball illustrated in FIG. 3.
Figure 3:
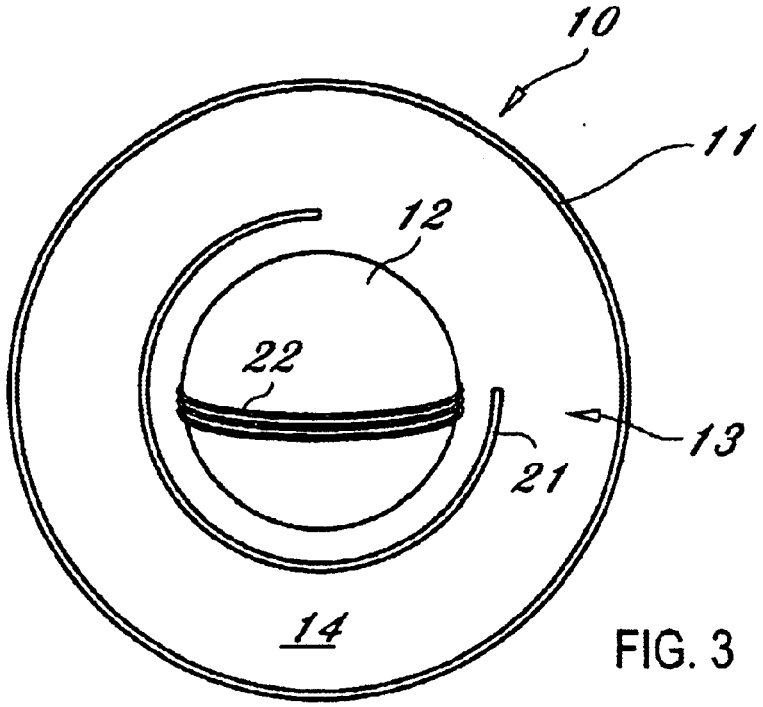
FIG. 3 is a partial section view of one embodiment of the inventive golf ball.

As shown in FIGS. 1 and 3, the present invention, in certain aspects, is directed to a golf ball 10 having an outer cover 11 that defines an inner core 13. The golf ball further includes a microprocessor 20, a power source 23, a receive and transmit (RT) device 22, a piezo sensor 21, and related circuitry (collectively referred to herein as "golf ball components). These golf ball components are electrically connected to one another and housed within the inner core 13 of the ball. In one preferred embodiment, the microprocessor 20 and power source 23 are housed within a centrally disposed compartment 12 while the RT device 22 and piezo sensor 21 are disposed outside of the compartment 12 within the inner core 13, as shown, for example, in FIG. 3. The centrally disposed compartment may comprise a rigid shell or cast core. In one embodiment, the compartment may be a titanium (or similar metal or metal alloy) shell encasing the microprocessor and power source, for example, as well as a filler material, such as plastic, for example, to secure electronics housed therein. Alternatively, the electronics (i.e. microprocessor and power source) may be cast in a high impact plastic or acrylic material. Regardless of the construction of the inner compartment 12, FIG. 3 illustrates one exemplary arrangement of the RT device 22 and piezo sensor 21; however, it will be appreciated by one of ordinary skill in the art that the RT device 22 and piezo sensor 21 may be arranged differently within the inner core 13.

As known by those of ordinary skill in the art, there are several types golf ball constructions, as described, for example, in U.S. Pat. No. 6,379,269 to Nesbitt, et al. (incorporated herein by reference in its entirety), all of which have an outer cover surrounding some type of inner core. The outer cover 11 of the present invention may be fabricated and designed by any number of materials and methods known to the skilled artisan. Similarly, the inner core 13 of the inventive golf ball may be so fabricated and designed, provided the design is such as to provide for housing of the golf ball components described and illustrated herein. In one embodiment, the inner core 13 may comprise a high energy filling material 14 between the compartment 12 and outer cover 11. Exemplary filling materials 14 include, but are not limited to, various cross-linked synthetic rubber compounds.

Figure 5:
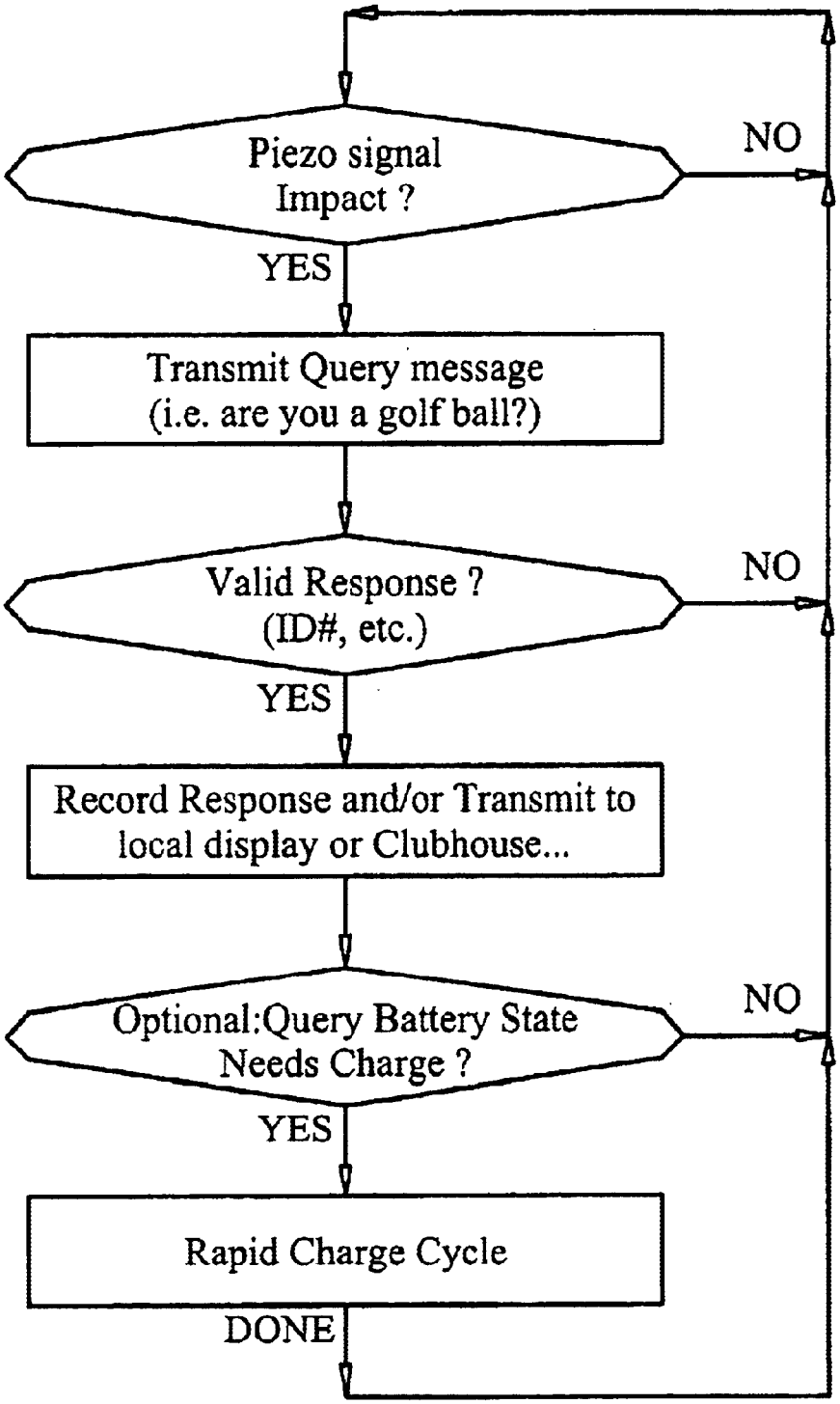
FIG. 5 is a flow chart illustrating exemplary software processing of the golf ball cup's microprocessor.

The inventive golf ball 10 is designed such that when the outer cover 11 of the ball is struck by an outside force, typically by a golfer's golf club, for example, the piezo sensor 21 generates a voltage to activate the microprocessor 20. Preferably, the voltage generated is proportionate to the magnitude of the force generated by the golfer's stroke. An exemplary piezo sensor 21 is a polyvinylidene fluoride (PVDF)-based film sensor. It will be appreciated by the skilled artisan that other sensors capable of "sensing" or being responsive to vibrations generated upon impact include, but are not limited to, MEMS-based accelerometers, and the like. As illustrated in FIG. 5, the microprocessor 20 is programmed to record stroke data corresponding to the number of strokes received by the golf ball by a golfer. In one embodiment of the invention, the microprocessor 20 is programmed to operate in a low power "sleep" mode until the impact of the golf club on the ball. The force of impact upon the ball then activates the piezo sensor to generate a voltage to "wake up" the microprocessor 20, which in turn, records the stroke. The microprocessor 20 is preferably further programmed to "lock out" recordation of any further impact forces acted upon the golf ball for a pre-determined period of time, thereby preventing recordations of false strokes upon the ball as the ball bounces while in play. That is, the microprocessor, in lock-out mode, will ignore signals transmitted by the piezo sensor corresponding to various impacts received by the ball after the golfer's stroke. The length of the lock-out is based upon the magnitude of the force of the stroke recorded, which is desirable to allow for both long drives and putts. After the lock-out period, the microprocessor returns to a low power "sleep" mode until the golfer's next stroke.

In other embodiments, the microprocessor may be further programmed to record various golf ball identification information, including, but not limited to, the golfer's name and golf ball identification number or code. Recordation of a unique golfer identification number or code is especially useful for "ball-in-play" verification, wherein the system will verify that the same ball is being played (and thus not substituted) during play.

Figure 6:
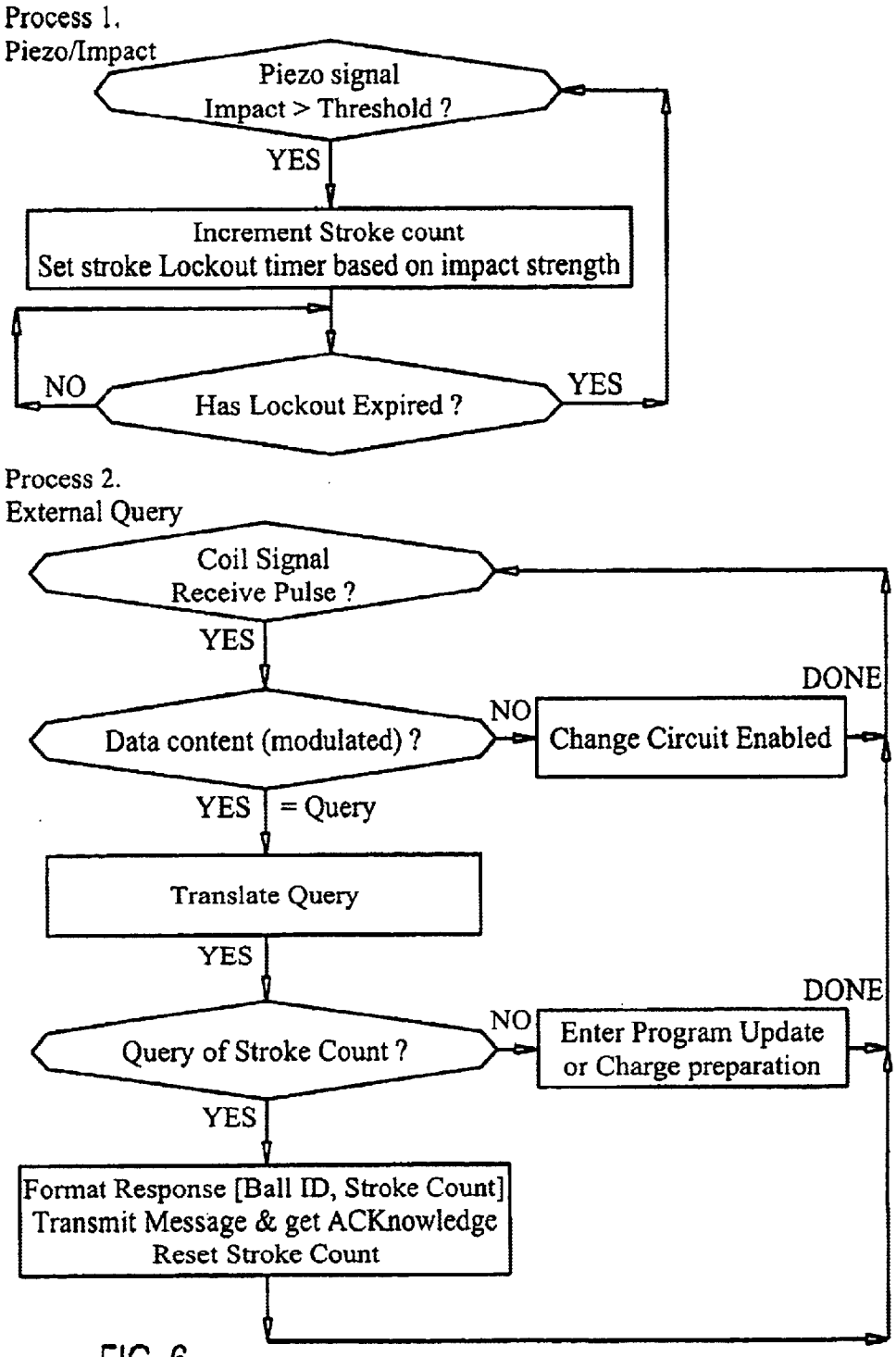
FIG. 6 is a flow chart illustrating exemplary software processing of the golf ball's microprocessor.

Referring now to FIGS. 5–6, when the golf ball is played, the microprocessor 20 and RT device 22, in combination, are designed to transmit information about the ball recorded therein to a system designed to receive and interpret such information. This information includes, but is not limited to, golf ball identification (e.g. golfer's name, golf ball identification number or code, etc.), the magnitude of force of the strokes received upon the ball, and the number of strokes received by the ball for a given hole. The present invention, therefore, further includes a golf ball cup 100 designed to receive the ball. Preferably the cup 100 is designed for installation within an outdoor golf course hole, and most preferably, for optimal benefits, the inventive cup 100 may be installed in every hole of the golf course. However, other embodiments of inventive system include installation of the cup on artificial putting greens, recreational miniature golf courses (i.e. "putt-putt" golf), and artificial indoor putting holes.

Figure 2:
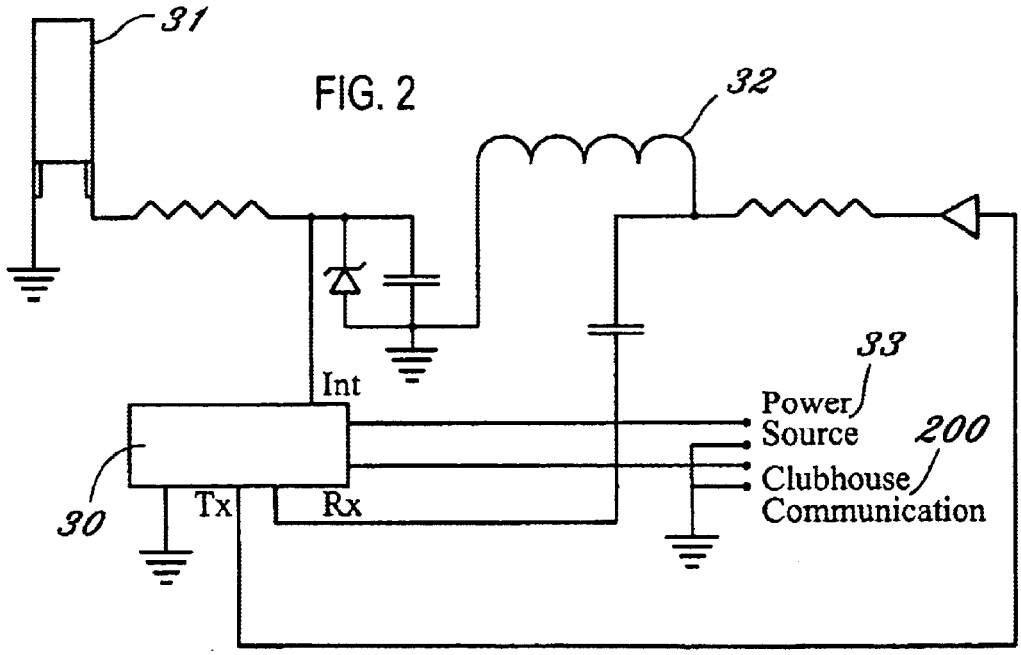
FIG. 2 is an exemplary schematic of electrical circuitry of one embodiment of the inventive golf ball cup illustrated in FIG. 4.
Figure 4:
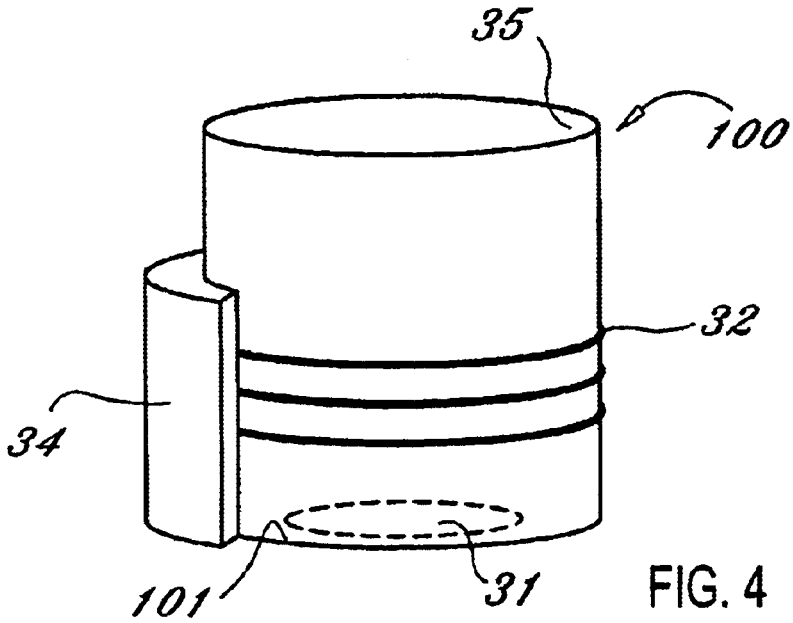
FIG. 4 is a partial section view of one embodiment of the inventive golf ball cup.

As shown in FIGS. 2 and 4, the cup 100 includes a microprocessor 30, a power source 33, a receive and transmit (RT) device 32, and a piezo sensor 31 (collectively referred to herein as the "cup components). The cup components are electrically connected to one another and mounted on or within the cup 100. FIG. 4 illustrates one arrangement of these cup components wherein the microprocessor 30, power source 33, and related circuitry are disposed within a housing compartment 34 located adjacent the outside of the cup 100. It will be appreciated by one of ordinary skill in the art, however, that alternative arrangements of the these cup components may be made without departing from the spirit of the invention. For example, preferably the piezo sensor 31 is secured to the floor 101 of the cup to ensure that it will be struck by the ball upon entry of the ball into the cup. Alternatively, one or more piezo sensors may be incorporated within, or secured to, the inner wall 35 of the cup 100 (not shown).

In operation, when the golf ball 10 lands inside the cup 100 and strikes the cup's piezo sensor 31, the sensor 31 generates a voltage to activate the cup's microprocessor 30 to interrogate the ball's microprocessor 20 via the respective RT devices 22, 32 of the ball and cup. The cup's microprocessor 30 then attempts to communicate with the golf ball's microprocessor 20 by energizing the cup's RT devices 32 and generating a signal corresponding to two components: 1) a large field burst that wakes up the ball's microprocessor 20 and 2) a standard pulsed communication mode for transmitting data. In one embodiment, if a signal is not received by the cup's microprocessor 20 (i.e. indicating perhaps an inactive or a conventional non-intelligent golf ball) within a specific pre-programmed period of time, the cup's microprocessor 30 returns to a low power sleep mode. When the inventive ball 10, however, lands in the inventive cup 100, the ball's microprocessor 20 is "awakened," verifies the integrity of the message, and then preferably transmits to the cup 100 various recorded information contained therein, such as golf ball identification data, the number of strokes received by the ball for that hole, the intensity of the strokes, and the like. Preferably, once the exchange of information between the two microprocessors 20, 30 has been made, the ball's microprocessor 20 is programmed to "reset" the stroke count to zero for the next play (i.e. hole). The ball's microprocessor 20 then, preferably, reverts back into a low power "sleep" mode until activation again upon impact of the ball 10.

The golf ball information retrieved by the cup's microprocessor 30 may then be forwarded, via the cup's microprocessor 30 and RT device 32, to a remote computer 200 for display or storage therein. The remote computer may be in a club house and/or remotely connected to a score terminal for display of some or all of the data transmitted The cup components and related circuitry may be powered by a power source 33 comprising a battery, low voltage wiring, or standard AC current. In the case of battery power, a charging probe, such as an RF (radio frequency) probe, may be inserted into the cup for a short period of time, perhaps during routine course maintenance to provide the appropriate charging field for the cup's power source. The cup's power source, in turn, is designed to charge the ball's power source.

In other embodiments of the present invention, the ball's microprocessor 20 may be reprogrammed via the cup's microprocessor 30 and RT device circuitry 32. The re-programming may comprise changing the various ball information stored therein (e.g. identification number or code, golfer information, etc.) or the actual software affecting the microprocessor's actions. During this reprogramming process, the signal received by the ball from the cup's microprocessor is a sequence of data which the ball's microprocessor's kernel directs into flash memory. As with the communication of strokes in play, there is a two-way communication exchanged via the two RT devices for verification of each byte of data received by the ball's microprocessor 20.

Figure 7:
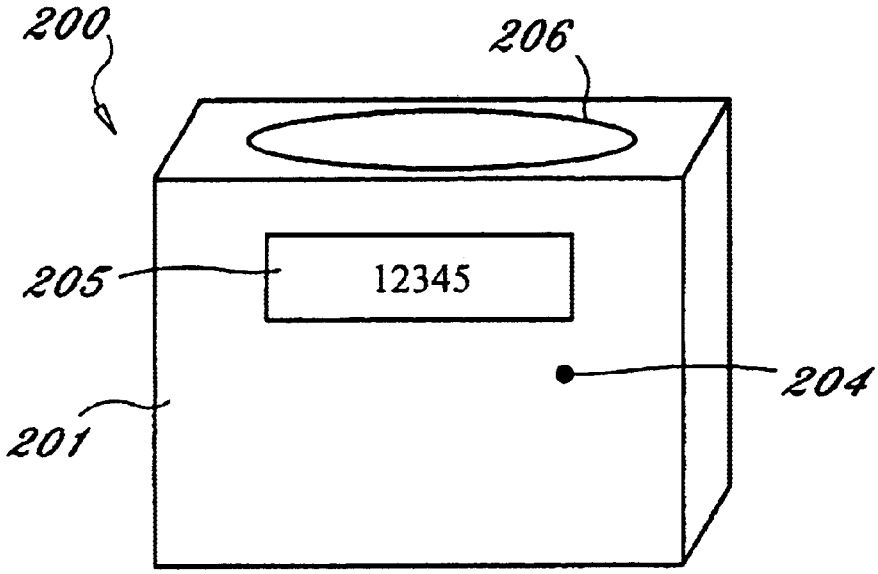
FIG. 7 illustrates another embodiment of the invention comprising a reading device for the inventive golf ball.
Figure 8:
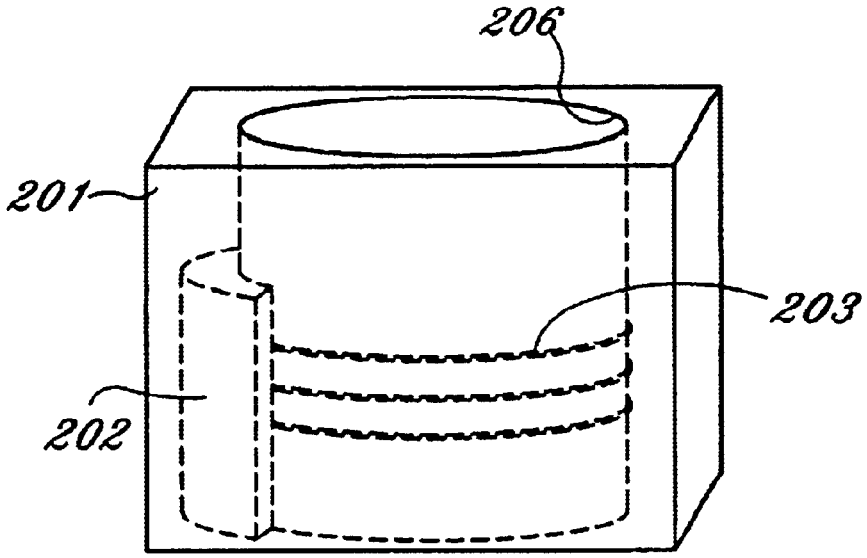
FIG. 8 is an internal view of the embodiment illustrated in FIG. 7.

FIGS. 7 and 8 illustrate another aspect of the present invention that may be used in lieu of, or in combination with, the inventive golf cup 100. Specifically in this embodiment, the present invention includes a golf ball reading device 200 that may be of any number of configurations, one of which is illustrated in FIG. 7, wherein the main components are contained within a housing unit 201. The reading device 200 includes a microprocessor, a power source, and related circuitry, all of which are not specifically shown in FIGS. 7–8, but indicated generally as being housed within a compartment 202. The reading device 200 further includes a receive and transmit (RT) 203 device similar to or identical to the respective components described above for the golf cup 100. In addition, the reading device may employ a switching device 204 to activate the reading device. The reading device may also include a display 205, such as an LCD display, for example, for displaying the information read. Alternatively, the microprocessor could be programmed to activate an auditory device (not shown), which in turn, transmits an auditory alert or a specific auditory alert to confirm that the original ball is in play (or is not in play). The primary function of the inventive golf ball reading device 200, therefore, would be to verify that the same golf ball is in play, and thus has not been switched during play. The golf ball, and more preferably the inventive golf ball 10 described herein, would therefore be placed near the reading device, or more preferably as shown in FIGS. 7–8, within a receptacle 206 contained within the device. Upon activation of the reading device, the device would read and verify the unique identification number or code, for example, of the golf ball in play via the respective microprocessors and RT devices of the golf ball and reading device 200. This operation would be performed identically as described above for the inventive golf cup and golf ball. The microprocessor and RT device of the inventive reading device 200 may also be designed to reprogram the inventive golf ball 10 as described above for the inventive golf cup 100.

For both the inventive golf ball, golf cup, and reading device described herein, conventional microprocessors known by those of ordinary skill in the art may be employed, such as, for example, MicroChip's PIC series of embedded processors. The RT devices for both the cup, ball, and reading device are preferably radio frequency (RF) coils; however, other types of non-contact communication devices may be employed, including, but not limited to, ultrasonic, audio, vibratory, and optical devices.

We claim:

1. A self-recording golf ball and cup system comprising:

a. a golf ball having an inner core surrounded by an outer cover;

b. said golf ball having a microprocessor pre-programmed with identification information corresponding to said ball, a power source, a receive and transmit device, and a piezo sensor electrically connected to one another and housed within said inner core of said golf ball;

c. said microprocessor further pre-programmed (i) to record data corresponding to one stroke upon activation of said microprocessor by said piezo sensor, (ii) to record a magnitude of force of said one stroke, and (iii) to subsequently ignore signals transmitted by said piezo sensor after said one stroke is received by said ball for a period of time thereafter correlative to said magnitude of force of said one stroke;

d. said microprocessor further programmed to record subsequent stroke data upon activation by said piezo sensor until later activated to erase said subsequent stroke data; and e. a golf ball cup for receiving said golf ball when said golf ball is struck therein, said cup having a microprocessor, a power source, a receive and transmit device, and a piezo sensor electrically connected to one another and mounted on or within said cup, such that when said ball strikes said cup piezo sensor upon entering said cup, said cup sensor activates said cup microprocessor, wherein said cup microprocessor is programmed to receive and record said data stored within said ball microprocessor and subsequently transmit, via said cup device, at least a portion of said data to a remote computer for display or storage therein.

2. The system of claim 1, wherein said golf ball microprocessor is further programmed such that upon transmission of data to said cup microprocessor, said data correlating to said number and magnitude of force of said strokes received by said ball is erased from said ball microprocessor.

3. The system of claim 1, wherein said ball microprocessor is programmed to remain in a low power sleep mode prior to activation by said ball piezo sensor.

4. The system of claim 3, said inner core of said golf ball further including a centrally disposed compartment, wherein said microprocessor and power source of said golf ball are housed within said compartment and said piezo sensor and device of said golf ball are disposed between said compartment and said outer cover.

5. The system of claim 1, wherein said receive and transmit device is selected from radio frequency coils, ultrasonic devices, audio devices, vibratory devices, and optical devices.

6. The system of claim 5, wherein said receive and transmit device is a radio frequency coil.

7. The system of claim 1, wherein said remote computer is operatively connected to a score terminal to display at least a portion of said data.

8. The system of claim 1, wherein said power source of said cup is rechargeable and designed further to recharge said power of source housed within said ball.

9. The system of claim 1, wherein said ball microprocessor is pre-programmed with golf ball identification data and wherein said cup microprocessor is further programmed to receive and record said golf ball identification data and subsequently transmit, via said cup receive and transmit device, at least a portion of said golf ball identification data to a remote computer for display or storage therein.

10. The system of claim 9, wherein said golf ball microprocessor is further programmed such that upon transmission of data to said cup microprocessor, said data correlating to said number and magnitude of force of said strokes received by said ball is erased from said ball microprocessor.

11. The system of claim 10, wherein said ball microprocessor is programmed to remain in a low power sleep mode prior to activation by said ball piezo sensor.

12. The system of claim 9, wherein said ball microprocessor is programmed to remain in a low power sleep mode prior to activation by said ball piezo sensor.

* * * * *